United States Patent [19]

Miller

[11] Patent Number: 4,827,844

[45] **Date of Patent: * May 9, 1989**

[54] ELECTRONIC FIRING CIRCUIT

[75] Inventor: Francis M. Miller, Snyder, N.Y.

[73] Assignee: Conax Florida Corporation, St. Petersburg, Fla.

[ * ] Notice: The portion of the term of this patent subsequent to Mar. 9, 2004 has been disclaimed.

[21] Appl. No.: 712,962

[22] Filed: Mar. 18, 1985

[51] Int. Cl.[4] ..... F42C 11/06

[52] U.S. Cl. ..... 102/220; 102/206; 361/251

[58] Field of Search ..... 102/220, 218, 206; 361/251

[56] References Cited

U.S. PATENT DOCUMENTS

| | | | |
|---|---|---|---|
| 3,913,484 | 10/1975 | Gardner | 102/220 |
| 4,012,671 | 3/1977 | Vaice | 102/220 |
| 4,024,440 | 5/1977 | Miller | 361/251 |
| 4,382,231 | 5/1983 | Miller | 324/439 |
| 4,513,248 | 4/1985 | Miller | 324/439 |

*Primary Examiner*—Charles T. Jordan

*Attorney, Agent, or Firm*—Christel, Bean & Linihan

[57] ABSTRACT

A circuit for operating a load device comprising an operating circuit including an energy storage device for providing electrical energy for operating the device and a voltage responsive switch having a control terminal and connected between a voltage source and energy storage device of the operating circuit to provide energy to the storage device and opening when the stored energy causes the voltage on both sides of the switch to be essentially the same thereby disconnecting the source from the operating circuit so that any short circuit in the load does not affect the source or the remainder of the circuit associated therewith. The circuit can be in combination with a structure having a conducting path, the load device can have a conductive casing physically contacting the path of the structure, there can be a conducting element within the casing, the device can be susceptible to short circuit conditions between the conducting element and casing, and the voltage source can be in the structure and have positive and negative terminals, one of which is connected to the path of the structure as a common return for a circuit including the source. The circuit can be an electronic firing circuit for an electro-explosive device.

20 Claims, 2 Drawing Sheets

ELECTRONIC FIRING CIRCUIT

BACKGROUND OF THE INVENTION

This invention relates to circuits for controlled charging and discharging of energy storage devices such as capacitors associated with a load, and more particularly to a new and improved circuit for preventing adverse conditions such as short circuits associated with the load from affecting the supply from which the capacitors are charged as well as the circuits associated with that supply.

One area of use of the present invention is in controlled firing of electro-explosive devices, although the principles of the invention can be variously applied. Electro-explosive devices find use in a variety of applications, for example parachute canopy release mechanisms, pressurized gas release devices for inflating floatation equipment such as life vests or life rafts, and many other applications. A typical circuit for activating an electro-explosive device includes a capacitor which is charged from a supply and then discharged in a controlled manner through the device. These electro-explosive devices or actuators normally have metal bodies which contain the explosive charge, and the explosive ignition bridgewire normally is insulated from the metal body of the device. In many instances, these metal-cased electro-explosive devices are attached to the metal body of the apparatus in which they operate and then the same metal body is used as the common electrical return line or path for the electrical system of the apparatus. Thus, a short circuit condition between the normally insulated ignition bridgewire and metal case of the electro-explosive device can have a detrimental effect on the apparatus electrical system. It would, therefore, be highly desirable to provide a capacitor charging and discharging control and firing circuit for an electro-explosive device which avoids or prevents such effects on the electrical system of which the device is a part.

SUMMARY OF THE INVENTION

It is, therefore, a primary object of this invention to provide a new and improved circuit for controlled charging and discharging of energy storage devices such as capacitors associated with a load.

It is a further object of this invention to provide such a circuit for preventing adverse conditions such as short circuits from affecting the supply from which the capacitors are charged as well as circuits associated with the supply.

It is a further object of this invention to provide a new and improved circuit for controlled capacitor charging and discharging for firing an electro-explosive device.

It is a further object of this invention to provide such a circuit which prevents the electro-explosive device from causing a short circuit in the electrical system of which it is a part.

It is a more particular object of this invention to provide a capacitor charging and discharging control and firing circuit for an electro-explosive device which is efficient and effective in operation.

It is a further object of this invention to provide such a circuit for use with a plurality of electro-explosive devices wherein a short circuit associated with one of the devices does not affect firing of any of the other devices.

The present invention provides a circuit for operating a load device comprising an operating circuit including energy storage means for providing electrical energy for operating the devices and voltage responsive switch means having a control terminal and connected between a voltage source and energy storage means of the operating circuit to provide energy to the storage means and opening when the stored energy causes the voltage on both sides of the switch to be essentially the same thereby disconnecting the source from the operating circuit so that any short circuit in the load does not affect the source or the remainder of the circuit associated therewith. The circuit of the present invention can be in combination with a structure having a conducting path, the load device can have conductive casing physically contacting the path of the structure, there can be a conducting element within the casing, the device can be susceptible to short circuit conditions between the conducting element and casing, and the voltage source can be in the structure and have positive and negative terminals, one of which is connected to the path of the structure as a common return for a circuit including the source.

The circuit of the present invention can be an electronic firing circuit for an electro-explosive device connected in series with a controlled switch and in parallel with an ignition capacitor, the circuit including a timing network comprising a timing capacitor, a constant current generator and a controlled switch connected in controlled relation to the generator and in controlling relation to the controlled switch associated with the electro explosive device, a voltage controlled switch having a control terminal and connected between a source of supply voltage and the ignition capacitor, the switch when closed in response to a signal on the control terminal thereof allowing charging of the ignition capacitor from the source to a level substantially equal to the supply voltage whereby the voltage on both sides of the switch becomes substantially equal causing the switch to open and thereby disconnecting the ignition capacitor from the supply, and the current flowing in the timing network closing the voltage controlled switch after a predetermined time to close the controlled switch and discharge the ignition capacitor through the electro-explosive device.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENT

Figure 1:
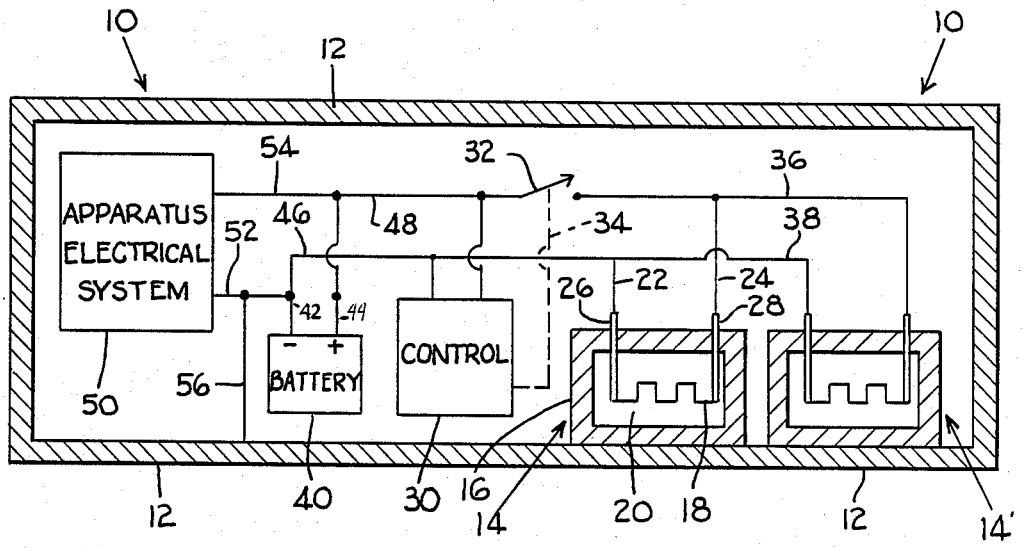
FIG. 1 is a diagrammatic view of an illustrative installation of electro-explosive devices in an apparatus including an electrical system.

FIG. 1 shows an illustrative form of apparatus containing an electro-explosive device and illustrating a problem solved by the present invention. The apparatus 10 includes a housing 12 of metal and contains at least one electro-explosive device, in particular, the two devices generally designated 14 and 14' in FIG. 1. Each device includes a housing or casing of metal 16, a bridgewire 18 therein, and an explosive charge 20 within the housing surrounding the bridgewire 18. Opposite ends of the bridgewire 18 are connected to an external electrical circuit for operating the same by conductors 22,24 which, in turn, are insulated from housing 16 by suitable means such as the insulating sheaths 26 and 28, respectively. In the apparatus shown, the metal housing 16 of each electro explosive device 14 is in contact with the metal housing 12 of the apparatus.

The apparatus further comprises a control generally designated 30 for operating the electro-explosive devices 14,14'. As indicated diagrammatically, control 30 operates to close a switch 32 or the equivalent via the operative connection indicated 34 to complete an electrical circuit including conductors 36 and 38 to the bridgewires of the electro-explosive devices causing ignition of the same in a known manner.

The apparatus further includes a source of electrical energy in the form of a battery 40 having negative and positive terminals 42 and 44, respectively. Battery 40 supplies the energy for operating control 30 as well as for operating the electro explosive devices 14,14' and is connected to the circuit including control 30 and conductors 36 and 38 by conductors 46 and 48.

The apparatus 10 also includes an electrical system generally designated 50 which is determined by the nature of the apparatus itself. System 50 is provided with electrical energy from battery 40 by conductors 52 and 54 connected to the negative and positive battery terminals. In the apparatus shown, the housing 12 serves as a common electrical return from the system 50 to battery 40 represented by the conductor 56 connected to housing 12 and to system 50 and battery 40.

In view of the foregoing, the common electrical return for system 50 and battery 40 is electrically connected to the conductive housing 12, and the conductive casing 16 of each electro-explosive device 14 is electrically connected to conductive housing 12. As a result, there is an electrical connection between the housing 16 of each electro-explosive device and the battery 40 and electrical system 50. In the event of a short circuit condition in any of the electro-explosive devices, the effect of this is conducted through housing 12 to battery 40 and system 50 with the possibility of damage thereto. Each bridgewire 18 of the electro-explosive devices normally is insulated from the housing 16. During explosive ignition and the release of ionized gases, however, there is the possibility of an electrical short circuit through such gas between bridgewire 18 and housing 16. Then such short circuit condition is transmitted through housing 12 to battery 40 and system 50 with the possibility of damage thereto.

Figure 2:
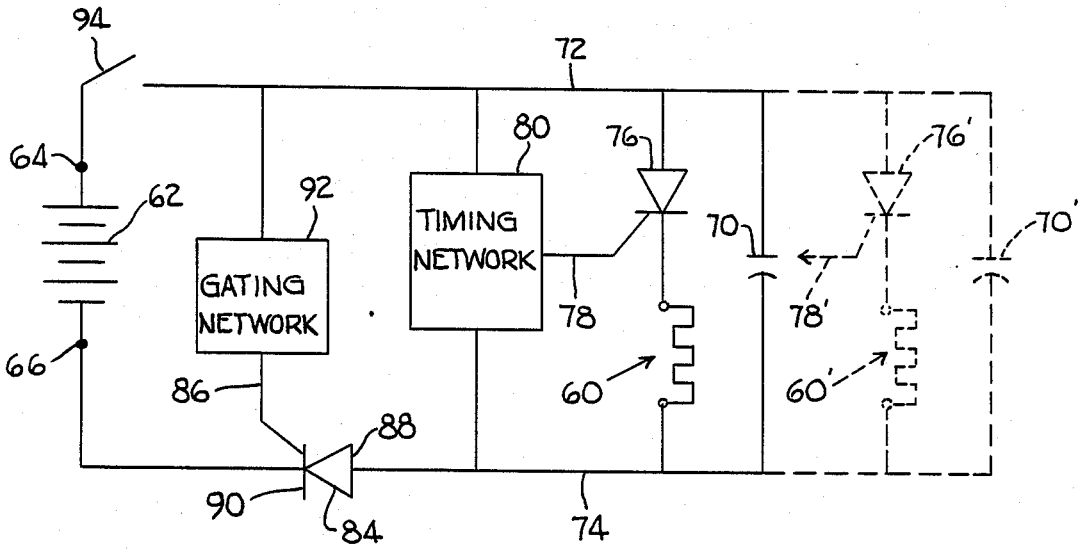
FIG. 2 is a block diagram of a circuit according to the present invention.

FIG. 2 illustrates the circuit according to the present invention for use with at least one load device generally designated 60 and illustrated in a form of a bridgewire of an electro-explosive device. As in the arrangement of FIG. 1, the load 60 is part of a load device having a conductive casing physically contacting an electrically conducting path of a structure, typically a metal housing, and a load device also has a conducting element within that casing electrically insulated therefrom. However, the devices is suspectible to short circuit conditions between the conducting element and casing. A voltage source for operating load device 60 is shown in the form of a battery 62 having positive and negative terminals 64 and 66, respectively. As in the arrangement of FIG. 1, the negative battery terminal 66 is connected to the conducting path of the aforementioned structure as a common return for an overall circuit including source 62.

There is provided a circuit for controlling the operation of load device 60 which includes energy storage means in the form of capacitor 70 for providing electrical energy for operating device 60 in a controlled manner as will be described. Capacitor 70 is charged from source 62 through conductors 72 and 74, and is discharged through device 60 under control of a voltage controlled switch 76 connected in series with device 60 and having a control terminal 78 connected to a timing network 80. Capacitor 70 is connected across the series combination of controlled switch 76 and load 60. Voltage for operating timing network 80 is obtained from source 62 through conductors 72 and 74. As will be described in further detail presently, after capacitor 70 is charged, timing network 80 applies a trigger signal after a predetermined time to control terminal 78 causing switch 76 to complete a discharge path for capacitor 70 through load 60. As illustrated in FIG. 2, the circuit of the present invention is capable of operating with a plurality of load devices as indicated by the additional device 60' together with capacitor 70' and controlled switch 76' shown in broken lines in FIG. 2.

In accordance with the present invention there is provided voltage responsive switch means 84 having a control terminal 86 and connected between source 62 and the energy storage means or capacitor 70 of the operating circuit to provide energy to the storage means when closed and then opening when the stored energy on capacitor 70 causes the voltage on both sides of switch 84 to be essentially the same thereby disconnecting source 62 from the operating circuit so that any short circuit condition in load 60 does not affect source 62 of the remainder of the circuit associated therewith. As shown in FIG. 2, controlled switch 84 is of the type having an anode terminal 88 connected to conductor 74 and a cathode terminal 90 connected to the negative terminal 66 of battery 62. Voltage for applying a turn-on signal to control terminal 86 is obtained from a gating network 92 connected to conductor 72. There is also provided switching means generally designated 94 connected between the positive terminal 64 of battery 62 and conductor 72 which when closed places the circuit in operation. The switching means 94 can of course have various forms including both manually operated and electrically operated controlled switching means.

Figure 3:
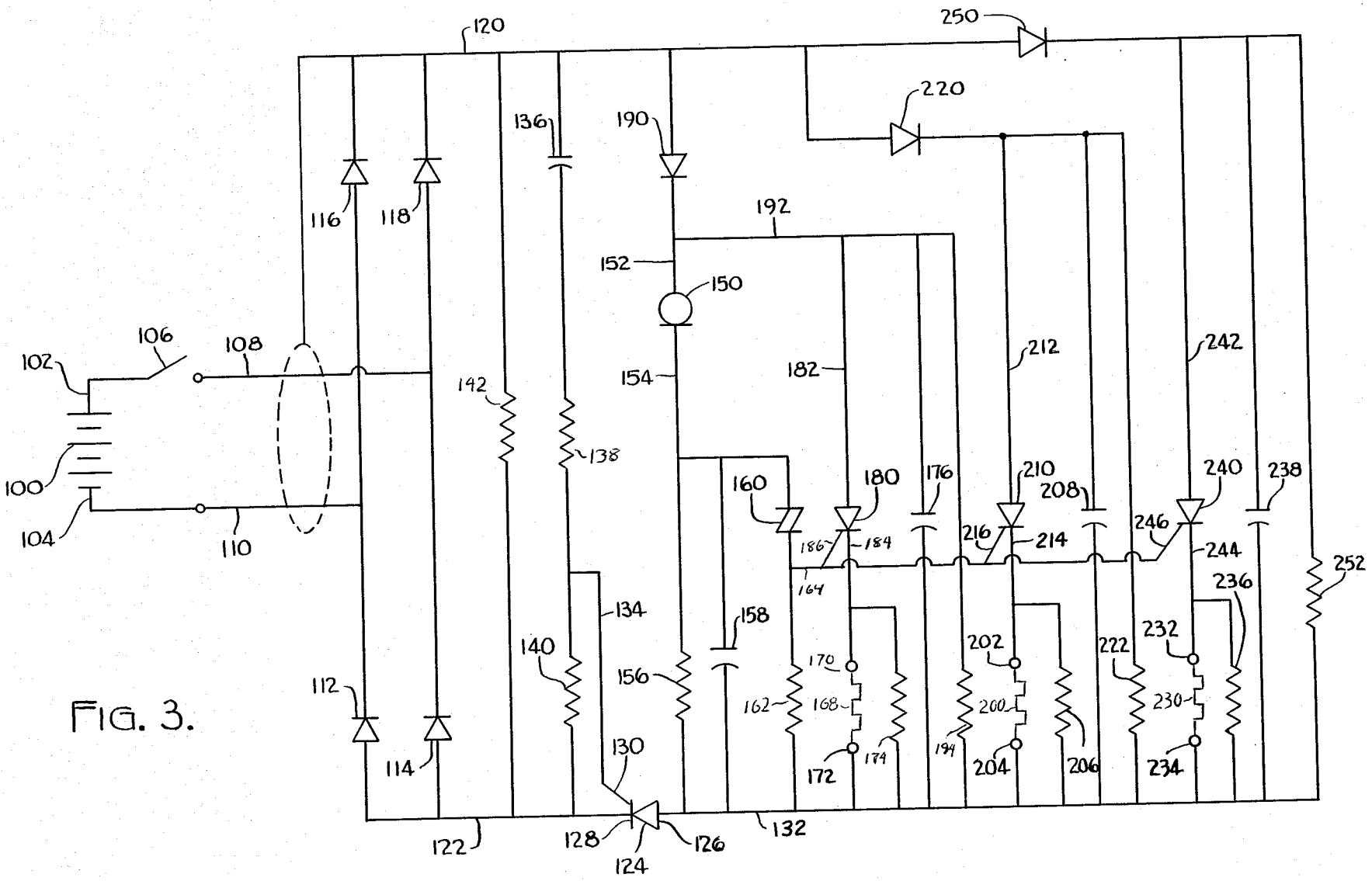
FIG. 3 is a schematic diagram of the circuit according to the present invention.

FIG. 3 shows a circuit according to the present invention for the controlled firing of a plurality of electro-explosive devices. Electrical energy for operating the circuit is provided by a voltage source in the form of battery 100 having positive and negative terminals 102 and 104, respectively. Application of voltage to the circuit is controlled by a normally opened switch 106 which is closed in response to a comand to fire the electro-explosive device. Battery 100 is connected by conductors 108 and 110 to a bridge rectifier comprising diodes 112, 114, 116 and 118. The bridge rectifier is connected to the remainder of the circuit in FIG. 3 by conductors 120 and 122. The battery 100 and switch 106 of the circuit of FIG. 3 are similar to battery 62 and switch 94 in FIG. 2.

The circuit of FIG. 3 further comprises voltage responsive switching means 124 similar to switch means 84 of FIG. 2 and having anode, cathode and gate terminals 126, 128 and 130, respectively. Anode terminal 126 is connected by line 132 to the remainder of the circuit, cathode 128 is connected to line 122, and gate terminal 130 is connected by line 134 to an RC network comprising the series combination of capacitor 136 and resistors 138 and 140 connected between the conductors 120 and 122. Line 134 is connected to the junction of resistors 138 and 140. A capacitor shunting resistor 142 is connected across the RC network.

The circuit of FIG. 3 further comprises a timing network for controlling the time of firing of the electro explosive devices. The timing network comprises a current regulating means in the form of a current regulating diode 150 having terminals 152 and 154, a resistor 156 connected between regulator terminal 154 and line 132, a capactior 158 connected in parallel with resistor 156, i.e. between regulator terminal 154 and line 132, and a bidirectional semiconductor switching means 160 having one terminal connected to regulator terminal 154 and the other connected through a resistor 162 to line 132. The signal output of the timing network is available on line 164 connected to the junction of switch 160 and resistor 162.

The circuit of FIG. 3 further includes three load branches each containing an electro-explosive device bridge wire, an ignition capacitor and a controlled semiconductor switch for completing a discharge path for the capacitor through the electro-explosive device. Referring to the first branch, it includes an electro-explosive device bridgewire 168 having a pair of terminals 170,172. Terminal 172 is connected to line 132 and a parallel safety resistor 174 is connected across the bridgewire 168, i.e. from terminal 170 to line 132. An ignition capacitor 176 is connected in parallel with bridgewire 168, one terminal of capacitor 176 being connected to line 132. A controlled discharge path for capacitor 176 through bridge wire 168 is provided by a controlled semiconductor switch in the form of silicon controlled rectifier 180 having an anode terminal connected by line 182 to the other terminal of capacitor 176, a cathode terminal connected by line 184 to bridgewire terminal 170, and a control or gate terminal connected by line 186 to line 164 from the timing network. The charging circuit for ignition capacitor 176 is completed by a diode 190, the anode of which is connected to line 120 and the cathode of which is connected to current regulator terminal 152 and by line 192 to the junction of capacitor 176 and SCR 180. The branch also includes a shunting resistor 194 connected across ignition capacitor 176, i.e. from the junction of capacitor 176 and SCR 180 to line 132 for a purpose to be described.

In a similar manner, the second branch includes an electro-explosive device bridgewire 200 having terminals 202,204, a safety resistor 206 connected across bridgewire 200, an ignition capacitor 208 in parallel with bridegewire 200, an SCR 210 having an anode connected by line 212 to the other terminal of capacitor 208, a cathode terminal connected by line 214 to bridgewire terminal 202 and a gate terminal connected by line 216 to line 164 from the timing network. The charging path for ignition capacitor 208 is completed by a diode 220, the anode of which is connected to line 120 and the cathode of which is connected to the junction of SCR 210 and capacitor 208. A shunting resistor 222 for capacitor 208 is provided, being connected from the junction of SCR 210 and capacitor 208 to line 132. Likewise, the third branch includes an electro-explosive device bridgewire 230 having terminals 232,234, a safety resistor 236 connected across bridgewire 230, an ignition capacitor 238 in parallel with bridgewire 230, an SCR 240 having an anode connected by line 242 to the other terminal of capacitor 238, a cathode terminal connected by line 244 to bridgewire terminal 232 and a gate terminal connected by line 246 to line 164 from the timing network. The charging path for ignition capacitor 238 is completed by a diode 250, the anode of which is connected to line 120 and the cathode of which is connected to the junction of SCR 240 and capacitor 238. A shunting resistor 252 for capacitor 238 is provided, being connected from the junction of SCR 240 and capacitor 238 to line 132.

The circuit of FIG. 3 operates in the following manner. Prior to a firing command, switch 106 is open and all of the capacitors are maintained at Zero volts d.c. by the shunting resistors 142, 156, 194, 222 and 252. In response to a command to fire the electro-explosive devices switch 106 is closed and the voltage of battery 100 is applied to the circuit input lines 108,110. A portion of that voltage is coupled to the gate of voltage responsive switch 124 through the RC network comprising capacitor 136 and resistor 138 which produces a relatively short turn-on signal having a duration of approximately 10 milliseconds. When switch 124 turns on it completes the charging paths for supplying charging current to the three separate ignition capacitors 176, 208 and 238, and it also completes a charging path for supplying charging current to timing capacitor 158. The charging current of the ignition capacitors 176, 208 and 238 is limited only by the impedance of switch 124 and the bridge rectifier comprising the four diodes. Therefore, the time required to fully charge the ignition capacitors is on the order of 50 milliseconds in a typical circuit. As the charging current falls off, it finally causes switch 124 to revert to its non-conducting state, effectively disconnecting the timing network and the ignition system from battery 100.

The timing network comprising regulating diode 150, capacitor 158, resistor 156 and switch 160 now draws current, approximately 0.22 milliamperes in an illustrative circuit, from capacitor 176 which is fully charged. The time constant of the network is controlled by the formula $T = (\underline{C}V\underline{br})/P.O.$ where the time in seconds is equal to the capacity in farads times the breakdown voltage of switch 160 in volts divided by the pinch-off current of regulator diode 150 in amperes. Therefore, the nominal time delay in an illustrative circuit is Tsec $=(4.7\times10^{-6}(\underline{8})=171/0.00022$ milliseconds. At the end of 171 milliseconds, the voltage on capacitor 158 exceeds the breakdown voltage (8 volts) of switch 160 causing the switch to turn on which then discharges capacitor 158 through the resistor 162 thereby providing an impulse type firing signal on line 164 which immediately is applied to the three parallel connected gates of the SCRS 180, 210 and 240.

The discharge of capacitor 158 through the SCR gates turns them on allowing the corresponding ignition capacitors 176, 208 and 238 to discharge through the corresponding bridgewires 168, 200 and 230 of the three electro-explosive devices causing ignition of those devices and operation of the associated mechanisms. Since switch 124 previously was turned off to effectively disconnect the timing network and the ignition system from battery 100, any short circuit condition between a bridgewire and its metal case during explosive ignition will not be reflected back to the battery or any circuit associated with it.

During the explosive combustion a short circuit condition may occur not only from the bridgewire to its case but also from pin to pin within the electro-explosive device itself. Should this occur, the firing circuit associated with that device could withdraw energy from the remaining two firing circuits, possibly causing failure to fire in those two circuits. Accordingly, the diodes 190,220 and 250 are provided in the circuit of FIG. 3 to prevent such an occurence.

By way of example, in an illustrative circuit, source 100 provides 20–30 volts d.c., the bridge rectifier comprising diodes 112, 114, 116 and 118 is Radio Shack PN 1151, resistors 138, 140 and 142 are 1 kilohm, 100 ohms and 100 kilohms, respectively, capacitor 136 is 10 microfarads, SCR 124 is RCA PNS26000, current regulating diode 150 is Crystallonics PN 1N5283, resistor 156 is 100 ohms, capacitor 158 is 4.7 microfarads and resistor 162 is 10 ohms, bidirection semicondcutor switch 160 is General Electric PN 2N4992, SCRs 180, 210 and 240 are RCA PN S2600D, each of capacitors 176, 208 and 238 is 1200 microfarads, each of resistors 194, 222 and 252 is 1 megohm, each of resistors 174, 206 and 236 is 1 kilohm, and each of diodes 190, 220 and 250 is General Electric PN1N4003. Electro-explosive devices 168, 200 and 230 can be Conax Corporation Part CC-131

It is therefore apparent that the present invention accomplishes its intended objects. While an embodiment of the present invention has been described in detail, that is for the purpose of illustration, not limitation.

I claim:

1. An electronic firing circuit for an electro-explosive device comprising:

(a) an electro explosive device connected in series with a controlled ignition switch and in parallel with an ignition capacitor having a pair of terminals;

(b) a timing network connected in controlling relation to said controlled ignition switch associated with said electro explosive device;

(c) a source of supply voltage having a pair of terminals;

(d) means for connecting one of said source terminals directly to one of said capacitor terminals;

(e) a voltage controlled switch having first and second terminals and a control terminal;

(f) means for connecting said first terminal of said switch directly to the other of said capacitor terminals;

(g) means for connecting said second terminal of said switch to the other of said source terminals;

(h) said switch when closed in response to a signal on the control terminal thereof connecting said timing network to said source and allowing charging of said ignition capacitor from said source to a level substantially equal to said supply voltage so that the voltage on both sides of said voltage controlled switch becomes substantially equal causing said voltage controlled switch to open and thereby disconnecting said ignition capacitor from said supply; and (i) said timing network operating after a predetermined time to close said controlled ignition switch and discharge said ignition capacitor through said electro explosive device.

2. An electronic firing circuit according to claim 1, wherein said timing network comprises a timing capacitor, a constant current generator and a controlled timing switch connected in controlled relation to said generator and in controlling relation to said controlled ignition switch associated with said electro-explosive device whereby the current flowing in said timing network closes said controlled timing switch after a predetermined time to close said controlled ignition switch and discharge said ignition capacitor through said electro-explosive device.

3. An electronic firing circuit according to claim 2, wherein said constant current generator comprises a current regulating diode.

4. An electronic firing circuit according to claim 2, wherein said controlled timing switch comprises a bidirectional semiconductor switch.

5. An electronic firing circuit according to claim 1, wherein said electro-explosive device, controlled ignition switch and ignition capacitor comprises a branch, and further including a plurality of identical ones of said branches connected in parallel and each comprising a corresponding electro-explosive device, controlled ignition switch and ignition capacitor, said timing network being connected in controlling relation to each of said controlled ignition switches of each of said branches and said voltage controlled switch being connected directly to each of said ignition capacitors of each of said branches.

6. An electronic firing circuit according to claim 1, wherein said supply voltage source has positive and negative polarity terminals and wherein said voltage controlled switch comprises a silicon controlled rectifier, the anode of which is connected to said ignition capacitor and the cathode of which is connected to said negative polarity terminal of said source.

7. An electronic firing circuit according to claim 1, further including protective diode means connected between said source and said ignition capacitor for allowing current flow in one direction from said source to said ignition capacitor.

8. An electronic firing circuit according to claim 5, further including protective diode means connected between each of said branches and said source for preventing a short circuit in any one of said branches from withdrawing energy from the remaining ones of said branches.

9. In combination with a structure having a conducting path, a load device having a conductive casing physically contacting said path of said structure, and a conducting element within said casing electrically insulated from said casing, said device being susceptible to short circuit conditions between said conducting element and casing, a voltage source in said structure having positive and negative terminals, one of which is connected to said path of said structure as a common return for a circuit including said source, an improved circuit for operating said load device comprising:

(a) an operating circuit including energy storage means having a pair of terminals for providing electrical energy for operating said device and one of said terminals of said energy storage means being connected directly to one of said voltage source terminals; and (b) voltage responsive switch means having first and second terminals and a control terminal to provide energy to said storage means, said first terminal of said switch being connected directly to the other of said terminals of said energy storage means and said second terminal of said switch being connected directly to the other of said voltage source terminals, said switch means opening when the stored energy causes the voltage on both sides of said switch means to be essentially the same thereby disconnecting said source from said operating circuit so that any short circuit in said load does not affect said source or the remainder of the circuit associated therewith.

10. Apparatus according to claim 9, further including a timing network connected in controlling relation to said operating circuit, said voltage responsive switch means connecting said timing network to said source, whereby said timing network after a predetermined time causes said operating circuit to operate said device.

11. Apparatus according to claim 10, wherein said timing network comprises a timing capacitor, a constant current generator and a controlled timing switch connected in controlled relation to said generator and in controlling relation to said operating circuit, whereby the current flowing in said timing network closes said controlled timing switch after a predetermined time to cause said operating circuit to operate said device.

12. Apparatus according to claim 11, wherein said constant current generator comprises a current regulating diode.

13. Apparatus according to claim 11, wherein said controlled timing switch comprises a bidirectional semiconductor switch.

14. Apparatus according to claim 9, wherein said load device comprises an electro-explosive device.

15. Apparatus according to claim 9, wherein said load device comprises an electro-explosive device and said operating circuit comprises a controlled ignition switch connected in series with said device and said energy storage means of said operating circuit comprises an ignition capacitor connected in parallel with said device.

16. Apparatus according to claim 9, wherein said load device and said operating circuit including said energy storage means comprises a branch, and further including a plurality of identical ones of said branches connected in parallel and each comprising a corresponding load device and operating circuit including energy storage means, said voltage responsive switch means being connected to each of said energy storage means of said branches.

17. Apparatus according to claim 9, wherein said voltage responsive switch means comprises a silicon controlled rectifier, the anode of which is connected to said energy storage means and the cathode of which is connected to the negative terminal of said voltage source.

18. Apparatus according to claim 9, further including protective diode means connected between said source and said energy storage means for allowing current flow in one direction from said source to said energy storage means.

19. Apparatus according to claim 16, further including protective diode means connected between each of said branches and said source for preventing a short circuit in any one of said branches from withdrawing energy from the remaining ones of said branches.

20. Apparatus according to claim 9, further including means for connecting said one terminal of said energy storage means directly to said positive terminal of said voltage source and means for connecting said second terminal of said switch directly to said negative terminal of said voltage source.

* * * * *